US009638158B2

(12) United States Patent
Ikeda et al.

(10) Patent No.: US 9,638,158 B2
(45) Date of Patent: May 2, 2017

(54) SPARK PLUG AND PLASMA GENERATING DEVICE

(71) Applicant: IMAGINEERING, INC., Kobe-shi, Hyogo (JP)

(72) Inventors: Yuji Ikeda, Kobe (JP); Minoru Makita, Kobe (JP)

(73) Assignee: IMAGINEERING, INC., Kobe (JP)

( * ) Notice: Subject to any disclaimer, the term of this patent is extended or adjusted under 35 U.S.C. 154(b) by 0 days.

(21) Appl. No.: 14/909,319

(22) PCT Filed: Aug. 1, 2014

(86) PCT No.: PCT/JP2014/070307

§ 371 (c)(1),
(2) Date: May 18, 2016

(87) PCT Pub. No.: WO2015/016337

PCT Pub. Date: Feb. 5, 2015

(65) Prior Publication Data

US 2016/0273509 A1 Sep. 22, 2016

(30) Foreign Application Priority Data

Aug. 1, 2013 (JP) ..... 2013-160862
Feb. 4, 2014 (JP) ..... 2014-019624

(51) Int. Cl.
*H01T 13/00* (2006.01)
*H01T 13/20* (2006.01)
(Continued)

(52) U.S. Cl.
CPC ..... *F02P 9/007* (2013.01); *H01T 13/04* (2013.01); *H01T 13/20* (2013.01); *H01T 13/40* (2013.01); *H05H 1/46* (2013.01); *H05H 1/52* (2013.01)

(58) Field of Classification Search
CPC ..... H01T 13/00; H01T 13/04; H01T 13/20; H01T 13/39; H01T 13/40; H05H 1/52; F02P 9/00; F02P 9/007
(Continued)

(56) References Cited

U.S. PATENT DOCUMENTS 7,305,954 B2 * 12/2007 Hagiwara ..... F02P 9/007 123/143 B
2005/0134159 A1 * 6/2005 Suzuki ..... H01T 13/467 313/141
(Continued)

FOREIGN PATENT DOCUMENTS

JP 2007-113570 A 5/2007
JP 2009-036198 A 2/2009
(Continued)

OTHER PUBLICATIONS

International Search Report dated Dec. 9, 2014, issued in counterpart Application No. PCT/JP2014/070307 (2 pages).

*Primary Examiner* — Thai Pham
(74) *Attorney, Agent, or Firm* — Westerman, Hattori, Daniels & Adrian, LLP

(57) ABSTRACT

To provide a spark plug that can reduce power loss and prevent erosion of a tip end part of a central electrode, even in a configuration such that a discharge current and an electromagnetic wave are emitted from a terminal fitting part of the spark plug, and a plasma generation device using the spark plug. The spark plug is provided with a central electrode 2 including a terminal fitting part 2A and an electrode main body 2B electrically connected to the terminal fitting part 2A, an insulator 3 formed with an axial hole 30, which the central electrode 2 is fitted into, a main fitting 4 that surrounds the insulator 3, and a ground electrode 5 that extends from an end surface of the main fitting 4 and is adapted to form a discharge gap that causes a spark dis-
(Continued)

charge between the central electrode 2 and the electrode main body 2B. The electrode main body 2B is constituted of a front electrode 25 including an electrode tip part 25a for causing the spark discharge with the ground electrode 5, a front dielectric cylinder 24 in a tube-like shape that covers the electrode tip part 25a, and a coupling conductive cylinder 23 in a tube-like shape that joins the front dielectric cylinder 24 and the terminal fitting part 2A.

7 Claims, 6 Drawing Sheets

(51) Int. Cl.

| | |
|---|---|
| ***F02P 9/00*** | (2006.01) |
| ***H01T 13/04*** | (2006.01) |
| ***H01T 13/40*** | (2006.01) |
| ***H05H 1/46*** | (2006.01) |
| ***H05H 1/52*** | (2006.01) |

(58) Field of Classification Search
USPC ..... 313/11.5, 118, 141, 145; 315/111.01, 315/111.21, 174, 29
See application file for complete search history.

(56) References Cited

U.S. PATENT DOCUMENTS

| | | | | |
|---|---|---|---|---|
| 2007/0046162 | A1* | 3/2007 | Moribe | H01T 13/36 313/143 |
| 2007/0114901 | A1* | 5/2007 | Nagasawa | F02P 9/007 313/141 |
| 2009/0229581 | A1 | 9/2009 | Ikeda | |
| 2010/0196208 | A1* | 8/2010 | Makita | F02P 3/01 422/83 |
| 2012/0176723 | A1* | 7/2012 | Ikeda | F02P 3/01 361/253 |

FOREIGN PATENT DOCUMENTS

| | | | |
|---|---|---|---|
| JP | 2012-127286 | A | 7/2012 |
| WO | 2011/016569 | A1 | 2/2011 |

* cited by examiner

SPARK PLUG AND PLASMA GENERATING DEVICE

TECHNICAL FIELD

The present invention relates to a spark plug electrically supplied at a central electrode thereof with a pulse voltage for a spark discharge and an electromagnetic wave provided as energy to the spark discharge, and a plasma generation device using the spark plug.

BACKGROUND ART

Conventionally, there has been developed a plasma generation device that generates local plasma by way of a spark plug discharge and enlarges the plasma by way of an electromagnetic wave such as a microwave (for example, see Japanese Unexamined Patent Application, Publication No. 2009-036198). The plasma generation device is provided with a mixing circuit that mixes a discharge current for a spark discharge (energy for the discharge) and energy of the electromagnetic wave from an electromagnetic wave generation device. The mixing circuit is electrically connected with a connection terminal part serving as an input terminal of the spark plug. As a result of this, a high voltage pulse (the discharge current) for the spark discharge and the electromagnetic wave are supplied to the spark plug through a same transmission line (electric path). Accordingly, the central electrode of the spark plug serves as both a spark discharge electrode and an antenna for electromagnetic wave emission.

However, a central electrode of a spark plug (hereinafter, in the spark plug, a whole portion extending from a terminal part connected with an ignition coil up to a tip end part that forms a discharge gap with a ground electrode is referred to as the "central electrode") generally used in a conventional plasma generation device is usually constituted by an iron-based alloy except in the tip end part. The electromagnetic wave provided from an alternating current power supply flows on a surface of the central electrode, the principal component of which is iron having a high magnetic permeability, resulting in a great power loss. Therefore, it has been difficult to downsize an electromagnetic wave oscillator.

Furthermore, the discharge current for the spark discharge and the electromagnetic wave are both emitted from the tip end part of the central electrode. Accordingly, between the tip end of the central electrode and the ground electrode, the electric fields caused by the discharge current and the electromagnetic wave culminate in intensity at an axial center part of the central electrode.

More particularly, the intensity of the electric field between the tip end of the central electrode and the ground electrode caused by the discharge current and the electromagnetic wave distributes in such a curved manner as to be symmetric about and culminating at the axial center of the central electrode and declining toward outer peripheries of an insulator that covers the central electrode as shown in FIG. 5. Accordingly, the electric field caused by the discharge current is superimposed on the electric field caused by the electromagnetic wave, thereby further increasing the electric field intensity, and the temperature becomes maximum at the axial center of the central electrode. As a result of this, there has been a problem such that the tip end part of the central electrode is prone to erosion.

PRIOR ART DOCUMENTS

Patent Documents

Patent Document 1: Japanese Unexamined Patent Application, Publication No. 2009-036198

THE DISCLOSURE OF THE INVENTION

Problems to be Solved by the Invention

The present invention is made in view of the above described circumstances, and it is an object of the present invention to provide a spark plug and a plasma generation device using the spark plug, wherein the spark plug can reduce the power loss of the electromagnetic wave and the erosion of the tip end part of the central electrode even in a configuration such that the discharge current and the electromagnetic wave are electrically provided to the terminal fitting part of the spark plug.

Means for Solving the Problems

In accordance with a first aspect of the present invention, there is provided a spark plug, including: a central electrode including a terminal fitting part electrically supplied from outside and an electrode main body electrically connected with the terminal fitting part; an insulator formed with an axial hole, which the central electrode is fitted into; a main fitting arranged in a manner so as to surround the insulator; and a ground electrode which extends from an end surface of the main fitting and is adapted to form a discharge gap for a spark discharge with the electrode main body, wherein the terminal fitting part is electrically supplied with a pulse voltage for the spark discharge and an electromagnetic wave provided as energy to the spark discharge. The electrode main body is constituted of a front electrode including an electrode tip part for causing the spark discharge with the ground electrode, a front dielectric cylinder in a tube-like shape covering the electrode tip part, and a coupling conductive cylinder in the tube-like shape joining the front dielectric cylinder and the terminal fitting part.

In the spark plug according to the first aspect of the present invention, energy (a discharge current) for the spark discharge flows from the terminal fitting part through a central part of an axial center of an electrode and discharges from a tip end of the electrode tip part. The electromagnetic wave, having a property of travelling on the surface of a material, flows from the terminal fitting part via the coupling conductive cylinder to the front dielectric cylinder and is emitted from a ground-electrode-side end surface of the front dielectric cylinder. As a result of this, between the tip end of the central electrode and the ground electrode, whereas the electric field caused by the discharge current becomes maximum in intensity at the axial center of the central electrode, the electric field caused by the electromagnetic wave becomes maximum in intensity on more outer side than the axial center of the central electrode (in a ring shape centering on the axial center), and a high temperature part does not concentrate at the axial center part. Accordingly, it is possible to effectively prevent erosion of the tip end part of the central electrode. Furthermore, since the electromagnetic wave effectively flows via the coupling conductive cylinder and the front dielectric cylinder as described above, it is possible to minimize the power loss. In this case, it is possible to more surely prevent erosion of the tip end part of the central electrode by configuring such that the tip end surface of the electrode tip part is located within the front dielectric cylinder or approximately on the same plane as the ground-electrode-side end surface of the front dielectric cylinder.

In accordance with a second aspect of the present invention, there is provided a spark plug, including: a central electrode including a terminal fitting part electrically supplied from outside and an electrode main body electrically connected with the terminal fitting part; an insulator formed with an axial hole, which the central electrode is fitted into; a main fitting arranged in a manner so as to surround the insulator; and a ground electrode, which extends from an end surface of the main fitting and is adapted to form a discharge gap for a spark discharge with the electrode main body, wherein the terminal fitting part is electrically supplied with a pulse voltage for the spark discharge and an electromagnetic wave provided as energy to the spark discharge. The electrode main body is constituted of a connection conductor electrically connected with the terminal fitting part, a coupling conductive cylinder coupled with the connection conductor on a side opposite to the terminal fitting part, a front dielectric cylinder fitted into an inner diameter side of the coupling conductive cylinder, and an electrode tip part inserted into the front dielectric cylinder. The connection conductor and the front electrode are electrically connected with each other via a resistor or a conductor.

According to the second aspect of the present invention, it is possible to effectively manufacture and assemble the spark plug by modularizing the electrode main body. The connection conductor and the front electrode are electrically connected with each other via the resistor or the conductor. Especially in a case in which the connection conductor and the front electrode are electrically connected with each other via the resistor, even though the resistor is incorporated therein to prevent electric noise of the spark plug, the electromagnetic wave effectively flows on surfaces of the connection conductor and the front dielectric cylinder and is emitted from an end surface of the front dielectric cylinder, thereby minimizing the power loss. Here, similarly to the first aspect of the present invention, it is possible to more surely prevent erosion of the tip end part of the central electrode by configuring such that the tip end surface of the electrode tip part is located within the front dielectric cylinder or approximately on the same plane as the ground-electrode-side end surface of the front dielectric cylinder.

In this case, the resistor may be made of a resistor composition powder filled in the front dielectric cylinder. The front dielectric cylinder is filled with the resistor composition powder (a composite powder material obtained by mixing a glass powder with a metal powder and a carbon powder) and heated at a temperature (900 to 1000 degrees Celsius) higher than the glass softening point, thereby sealing and fixing the modular parts of the electrode main body with each other.

In accordance with a third aspect of the present invention, there is provided a spark plug, including: a central electrode including a terminal fitting part electrically supplied from outside and an electrode main body electrically connected with the terminal fitting part; an insulator formed with an axial hole, which the central electrode is fitted into; a main fitting arranged in a manner so as to surround the insulator; and a ground electrode that extends from an end surface of the main fitting and is adapted to form a discharge gap for a spark discharge with the electrode main body, wherein the terminal fitting part is electrically supplied with a pulse voltage for the spark discharge and an electromagnetic wave provided as energy to the spark discharge. The electrode main body is constituted of a main central electrode that extends from a central part of an end surface of the terminal fitting part, a rear conductive cylinder electrically connected with the terminal fitting part, and a front conductive cylinder having one end thereof electrically connected with the rear conductive cylinder and the other end thereof located in the vicinity of the ground electrode. The main central electrode is covered by the rear conductive cylinder and the front conductive cylinder. The main central electrode is supported at the connection part of the rear conductive cylinder and the front conductive cylinder via a tube-like shaped insulating material. Assuming that the wavelength of the supplied electromagnetic wave is $\lambda$, a length of a ring-like shaped gap between the front conductive cylinder and the main central electrode is configured to be $\lambda/4$ in an axial direction, and a length of a ring-like shaped gap between the rear conductive cylinder and the main central electrode is configured to be $\lambda/2$ in the axial direction.

In the spark plug according to the third aspect of the present invention, the length of the ring-like shaped gap between the front conductive cylinder and the main central electrode is configured to be $\lambda/4$ in the axial direction, and the length of the ring-like shaped gap between the rear conductive cylinder and the main central electrode is configured to be $\lambda/2$ in the axial direction so that the ring-like shaped gap between the rear conductive cylinder and the main central electrode should form a resonating structure serving as an imaginary ground, thereby the ring-like shaped gap between the front conductive cylinder and the main central electrode can form a resonating structure (hereinafter, referred to as a "front resonating structure") having a length of $\lambda/4$. Without the front resonating structure, a part of the electromagnetic wave that flows on the surfaces of the rear conductive cylinder and the front conductive cylinder would flow in the ring-like shaped gap between the front conductive cylinder and the main central electrode without being emitted from an opening end surface of the front conductive cylinder into a combustion chamber. However, owing to the front resonating structure, it is possible to forcibly emit the part of the electromagnetic wave into the combustion chamber, thereby increasing the electric field intensity.

In this case, the opening end of the front conductive cylinder may be spread open. As a result of this, the electric field caused by the electromagnetic wave becomes maximum in intensity at a ring-shaped location on more outer side than the axial center of the central electrode, and it is possible to effectively prevent erosion of the tip end part of the central electrode.

Furthermore, in these cases, a high melting point metal may be provided at the opening end of the front conductive cylinder. As a result of this, it is possible to effectively prevent erosion of the opening end of the front conductive cylinder.

The present invention is further directed to a plasma generation device provided with the spark plug. There is provided a plasma generation device including: an ignition coil for supplying a discharge voltage; an electromagnetic wave oscillator that oscillates an electromagnetic wave; a mixer that mixes energy for a spark discharge and energy of the electromagnetic wave; and the spark plug that introduces a pulse voltage for the spark discharge and the electromagnetic wave provided as energy to the spark discharge into a reaction region in which a combustion reaction or a plasma reaction is performed. As a result of this, the plasma generation device according to the present invention can reduce the power loss of the electromagnetic wave (microwave)

introduced into the reaction region, using the spark plug that can effectively prevent erosion of the tip end part of the central electrode. Consequently, it is possible to use the spark plug for a long time period and to downsize the electromagnetic wave oscillator.

In the terminology of the present invention, a conductor (the coupling conductive cylinder) denotes a metal material such as iron, silver, copper, gold, aluminum, tungsten, molybdenum, titanium, zirconium, niobium, tantalum, bismuth, lead, tin, an alloy composed mainly of these metals, or a composite material of these metals, and a dielectric (the front dielectric cylinder) denotes a dielectric material such as a ceramic based on alumina ($Al_2O_3$) or the like.

Effect of the Invention

According to the present invention, it is possible to effectively prevent erosion of the tip end part of the central electrode and reduce the power loss of the supplied electromagnetic wave, even though the spark plug is configured to be electrically supplied with the discharge current and the electromagnetic wave at the terminal fitting part of the spark plug. Furthermore, in the plasma generation device using the spark plug, it is possible to downsize the electromagnetic wave oscillator, thereby downsizing the overall device and reducing in cost.

BEST MODE FOR CARRYING OUT THE INVENTION

In the following, detailed descriptions will be given of embodiments of the present invention with reference to the accompanying drawings. It should be noted that the following embodiments are mere examples that are essentially preferable, and are not intended to limit the scope of the present invention, applied field thereof, or application thereof.

<First Embodiment>

Spark Plug

The first embodiment is directed to a spark plug 1 according to the present invention.

Figure 1:
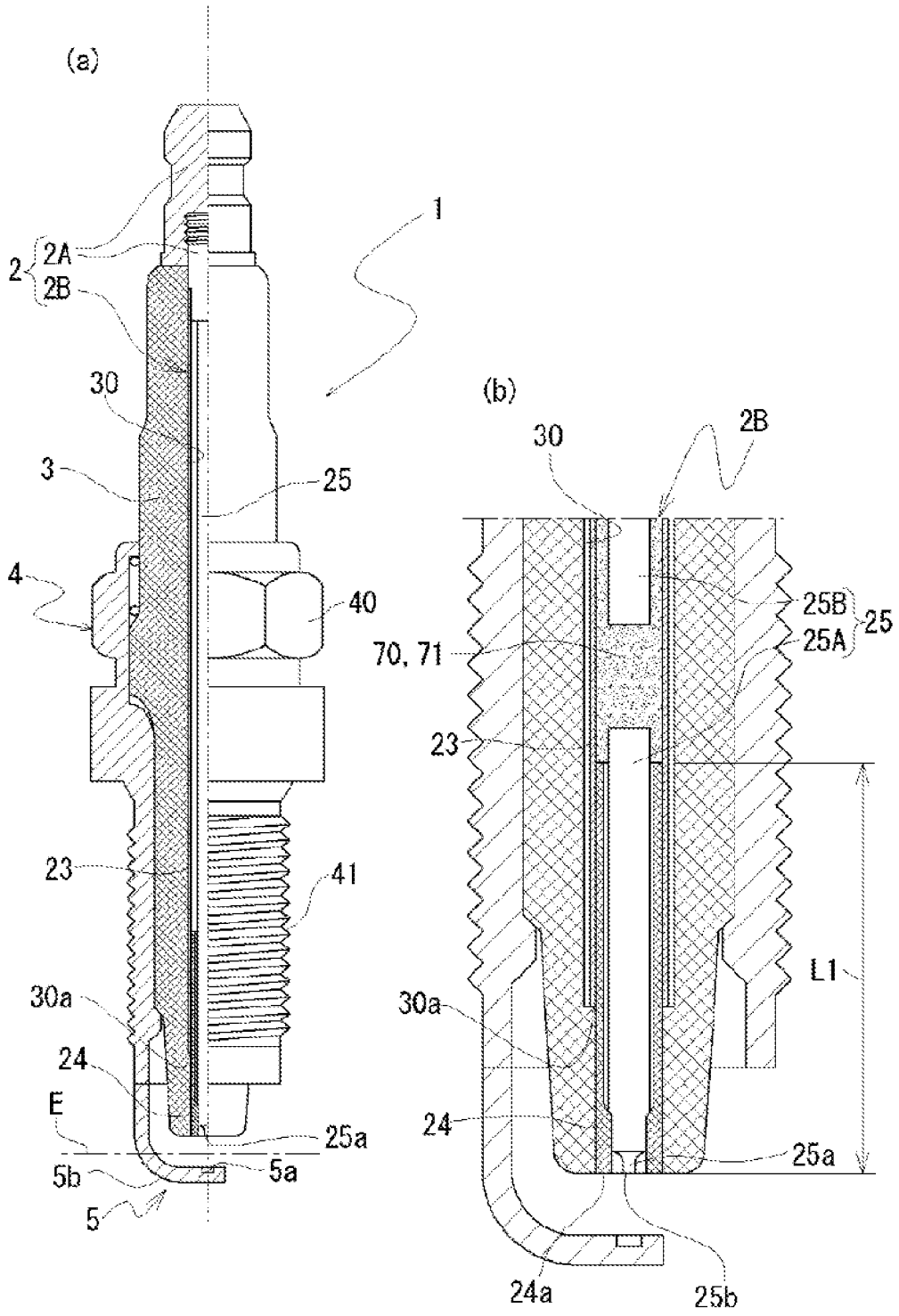
FIG. 1A is a partial cross sectional view of a spark plug according to a first embodiment of the present invention.
FIG. 1B is a partially enlarged cross sectional view showing an example of a divided front electrode of an electrode main body of the spark plug.

FIG. 1 shows the spark plug 1 according to the first embodiment. The spark plug 1 is provided with a central electrode 2 including a terminal fitting part 2A electrically supplied from outside and an electrode main body 2B electrically connected with the terminal fitting part 2A, an insulator 3 formed with an axial hole 30, which the electrode main body 2B of the central electrode 2 is fitted into, a main fitting 4 arranged in a manner so as to surround the insulator 3, and a ground electrode 5 that extends from a tip end surface of the main fitting 4 and forms a discharge gap for a spark discharge with the electrode main body 2B of the central electrode 2. A pulse voltage for the spark discharge and an electromagnetic wave provided as energy to the spark discharge are electrically supplied to the terminal fitting part 2A of the central electrode 2.

In the spark plug 1, the electrode main body 2B is constituted by a front electrode 25 including an electrode tip part 25*a* adapted for causing the spark discharge with the ground electrode 5, a front dielectric cylinder 24 in a tube-like shape covering the electrode tip part 25*a*, and a coupling conductive cylinder 23 in a tube-like shape joining the front dielectric cylinder 24 and the terminal fitting part 2A. A tip end surface 25*b* of the electrode tip part 25*a* is configured to locate within the front dielectric cylinder 24 or approximately on the same plane as a ground-electrode-side end surface 24*a* of the front dielectric cylinder 24.

The insulator 3 is a ceramic based on alumina ($Al_2O_3$) or the like having high insulation and resistance to heat and corrosion. The insulator 3 is manufactured by a well-known method such that alumina powder is formed by isostatic pressing, ground by whetstone or the like, and baked at approximately 1600 degrees Celsius. The axial hole 30, which the central electrode 2 is fitted into, is formed with a ramp part 30*a* for locking an end part on a side of the ground electrode 5 of a coupling conductive cylinder 23, which will be described later, of the electrode main body 2B.

Positioning between the tip end surface 25*b* of the electrode tip part 25*a* and the ground-electrode-side end surface 24*a* of the front dielectric cylinder 24 is performed in a manner such that the front electrode 25, which is formed with the electrode tip part 25*a*, is provided on an outer peripheral surface thereof with a ramp part having a small diameter on a front side of the central electrode 2, the front dielectric cylinder 24 is provided on an inner surface thereof with a ramp part having a large diameter on a rear side of the central electrode 2, and the ramp part of the front electrode 25 is engaged with the ramp part of the front dielectric cylinder 24. As a tip end part of the electrode tip part 25*a*, a noble metal having a high melting point and oxidation resistance such as platinum alloy and iridium may be preferably employed.

The coupling conductive cylinder 23 is not limited to a particular material, and any metallic conductor may suffice. However, it is preferable to use a low impedance metal such as silver, copper, gold, aluminum, tungsten, molybdenum, titanium, zirconium, niobium, tantalum, bismuth, lead, tin, an alloy composed mainly of these metals, a composite material of these metals, or a material coated with these metals. Especially, a material coated with titanium is preferably employed.

As the front dielectric cylinder 24, similarly to the insulator 3, a ceramic based on alumina ($Al_2O_3$) or the like having high insulation and resistance to heat and corrosion is preferably employed. The length L1 of the front dielectric cylinder 24 is preferably λ/4 or more in an axial direction, assuming that the wavelength of the supplied electromagnetic wave (microwave) is λ. The front dielectric cylinder 24 is fitted into an inner diameter part of the coupling conductive cylinder 23 so as to be connected with the coupling conductive cylinder 23. However, a method of the connection is not particularly limited to this.

FIG. 1A shows an example in which one end part of the front electrode 25 on a side of the ground electrode 5 constitutes the electrode tip part 25*a*, and the other end part is directly connected with the terminal fitting part 2A. However, the front electrode 25 is not limited to this configuration.

As shown in FIG. 1B, a predetermined gap is preferably provided between an inner surface of the axial hole 30 of the insulator 3 and an outer surface of the coupling conductive cylinder 23. The gap is filled with a conductive mixed powder 70 and sealed and fixed at a temperature (900 to 1000 degrees Celsius) higher than the glass softening point, thereby joining the central electrode 2 to the insulator 3. More particularly, the electrode main body 2B of the central electrode 2 is inserted into the axial hole 30, and an end part of the coupling conductive cylinder 23 of the electrode main body 2B is engaged with the ramp part 30*a* of the axial hole 30 so that the tip end surface 25*b* of the electrode tip part 25*a* is located within the front dielectric cylinder 24 or approximately on the same plane as the ground-electrode-side end surface 24*a* of the front dielectric cylinder 24 and that the ground-electrode-side end surface 24*a* of the front dielectric cylinder 24 is located on the same plane as a tip end of the insulator 3. Subsequently, a predetermined amount of the conductive mixed powder 70 is filled between the inner surface of the axial hole 30 of the insulator 3 and the outer surface of the coupling conductive cylinder 23 and is heated at a temperature higher than the glass softening point, thereby sealing and fixing the coupling conductive cylinder 23 (the central electrode 2) to the insulator 3. In the present embodiment, the conductive mixed powder 70 is employed to join the central electrode 2 to the insulator 3, and therefore may be configured by a glass powder alone without including a conductive powder.

By thus configuring the electrode main body 2B, the electromagnetic wave (microwave), having a property of travelling on the surface of a conductive or dielectric material, flows on the surfaces of the terminal fitting part 2A, the coupling conductive cylinder 23, and the front dielectric cylinder 24, and is emitted from the ground-electrode-side end surface 24*a* of the front dielectric cylinder 24 toward the side of the ground electrode 5. Consequently, a peak region of the intensity of the electric field caused by the electromagnetic wave appears off-axis of the central electrode 2, and thus, is placed out of a peak region of the intensity of the electric field caused by the discharge current. As a result of this, it is possible to effectively prevent erosion of the electrode tip part 25*a*, which is a tip end part of the central electrode 2.

The terminal fitting part 2A is an axis-like body electrically connected at a front end thereof with the electrode main body 2B. The terminal fitting part 2A is electrically connected at the front end surface thereof with the front electrode 25 of the electrode main body 2B, and is electrically connected with the coupling conductive cylinder 23 of the electrode main body 2B in a manner such that a ramp part is provided on a front side surface of the terminal fitting part 2A and fitted into the coupling conductive cylinder 23. However, the method of connecting the terminal fitting part 2A and the electrode main body 2B is not particularly limited to this, and the terminal fitting part 2A and the electrode main body 2B may be integrally formed.

An input terminal part of the terminal fitting part 2A may be configured to have a flange part, which is adapted to abut on a rear end surface of the insulator 3. However, the flange part will be a reflection point of the supplied microwave, which induces a power loss. Accordingly, as shown in FIG. 1, the terminal fitting part 2A is preferably configured in a straight shape without having any uneven part such as the flange part. Also, as shown in FIG. 1, the terminal fitting part 2A may be engraved at a rear end thereof with a thread, which the input terminal is threaded into. In the present specification, the input terminal and the part engraved with the thread are inclusively referred to as the "terminal fitting part 2A".

The main fitting 4 is an approximately cylindrical shaped case made of metal. The main fitting 4 is adapted to support an outer periphery of the insulator 3 and accommodate the insulator 3. A front inner peripheral surface of the main fitting 4 is separated from a front outer peripheral surface of the insulator 3 forming a gap therebetween. A male thread part 41 is formed on a front outer peripheral surface of the main fitting 4 as an installation structure to an internal combustion engine. The spark plug 1 is screwed and fixed to a cylinder head by threading the male thread part 41 of the main fitting 4 into a female thread part of a plug hole of the cylinder head (not shown). The main fitting 4 is formed with a wrench fitting part 40 for fitting with a plug wrench at a higher part thereof. Between the wrench fitting part 40 of the main fitting 4 and the insulator 3, powder talc is filled as a seal member, and an end part of the main fitting 4 is mechanically caulked.

The ground electrode 5 forms the discharge gap for the spark discharge with the central electrode 2. The ground electrode 5 is constituted of a ground electrode main body 5*b* and a ground electrode tip part 5*a*. The ground electrode main body 5*b* is a conductor in a shape of a curved plate. The ground electrode main body 5*b* is joined at one end thereof to the tip end surface of the main fitting 4. The ground electrode main body 5*b* extends from the tip end surface of the main fitting 4 along an axial center of the spark plug 1 and is bent approximately 90 degrees inward. The ground electrode main body 5*b* is provided with the ground electrode tip part 5*a* at a tip end side thereof, which faces toward the electrode tip part 20*a* provided to the tip end of the electrode main body 20.

According to the above described configuration, in the spark plug 1, the discharge current for the spark discharge that has electrically supplied from the terminal fitting part 2A flows through a center of the electrode main body 2B so as to cause the spark discharge at a gap part between the electrode tip part 25*a* and the ground electrode tip part 5*a*. While, on the other hand, the electromagnetic wave (microwave) provided as energy to the spark discharge is emitted in a ring shape so as to surround the axial center of the central electrode 2 from the ground-electrode-side end surface 24*a* of the front dielectric cylinder 24 via the coupling conductive cylinder 23 and the front dielectric cylinder 24, thereby preventing temperature rise at the axial center part of the central electrode 2.

Effect of First Embodiment

Figure 2:
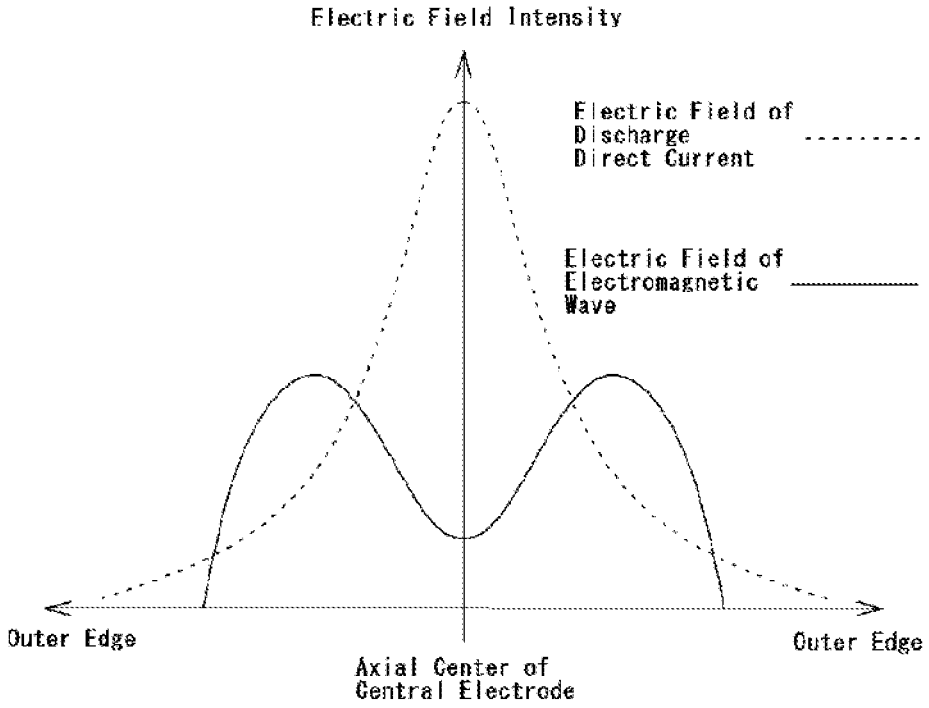
FIG. 2 is a graph showing electric field intensity distributions of the spark plug respectively caused by a discharge current and an electromagnetic wave.

In the spark plug 1 according to the first embodiment, whereas the discharge current for the spark discharge is emitted from the axial center of the central electrode 2, the electromagnetic wave provided as energy to the spark discharge is emitted in the ring shape so as to surround the axial center of the central electrode 2. Consequently, as shown in FIG. 2, between the tip end of the central electrode 2 (the tip end of the electrode tip part 25*a*) and the ground electrode 5 (i.e., on a plane shown by the dashed-dotted line E of FIG. 1), whereas the intensity of the electric field caused by the discharge current becomes maximum at the axial center of the central electrode 2, the intensity of the electric field caused by the electromagnetic wave becomes maximum on the more outer side than the axial center of the central electrode 2 (in a ring shape centering on the axial center), and a high temperature part does not concentrate on the axial center part of the central electrode 2. Thus, it becomes possible to effectively prevent erosion of the tip end of the electrode tip part 25*a*, which is the tip end part of the central electrode 2. Furthermore, it becomes possible to provide a spark plug having low power loss of the supplied electromagnetic wave.

First Modified Example of First Embodiment

According to a first modified example of the first embodiment, the front electrode 25 is configured to be divided into an electrode tip part main body 25A and a coupling body 25B. More particularly, as shown in FIG. 1B, the front electrode 25 is configured to be divided into the electrode tip part main body 25A provided with the electrode tip part 25*a* and the coupling body 25B electrically connected with the terminal fitting part 2A. A gap between end surfaces of the electrode tip part main body 25A and the coupling body 25B may be sealed by heating at a temperature (900 to 1000 degrees Celsius) higher than the glass softening point an intervening powder (hereinafter, referred to as the "conductive mixed powder 70") obtained by adding an electrically conductive glass powder to copper tungsten mixed powder, chromium nickel mixed powder, or titanium nickel mixed powder. As the intervening powder, a resistor composition powder 71 (a composite powder material obtained by mixing a glass powder, a metal powder, and a carbon powder) alone or a mixture of the resistor composition powder 71 and the conductive mixed powder 70 may be filled in the gap and heated at a temperature higher than the glass softening point, thereby sealing and fixing the front electrode 25, the front dielectric cylinder 24, and the coupling conductive cylinder 23.

In an internal combustion engine for a vehicle, a resistor is equipped in a plug cord or a plug cap of an ignition coil for pulse voltage application for the purpose of preventing the influence of a noise caused by a spark discharge on electronic devices of the vehicle (electric noise prevention). As a method less expensive than providing the resistor in the plug cord or the plug cap, another method is generally employed of providing the resistor inside the spark plug. A resistor enclosed in a recent spark plug called "monolithic type" is formed in a manner such that a gap between an electrode main body of a central electrode and a terminal fitting part is filled with a composite powder material obtained by mixing a glass powder, a metal powder, and a carbon powder and then sealed at a temperature (900 to 1000 degrees Celsius) higher than the glass softening point. In the spark plug 1 according to the first modified example of the first embodiment, by filling the gap with the resistor composition powder 71, it is possible to prevent the electric noise upon application of the discharge current, even without a resistor provided upstream of the spark plug 1.

In a case without the intervening resistor between the end surfaces of the electrode tip part main body 25A and the coupling body 25B, the plug cord or the plug cap of the ignition coil is configured to be equipped with a resistor.

<Second Embodiment>

Spark Plug

The second embodiment is directed to the spark plug 1 according to the present invention. The second embodiment is different from the first embodiment in structure of the central electrode 2 of the spark plug 1. Descriptions are omitted of constituents similar to the first embodiment such as the insulator 3, the main fitting 4, the ground electrode 5, and the like.

Figures 3, 3A, 3B:
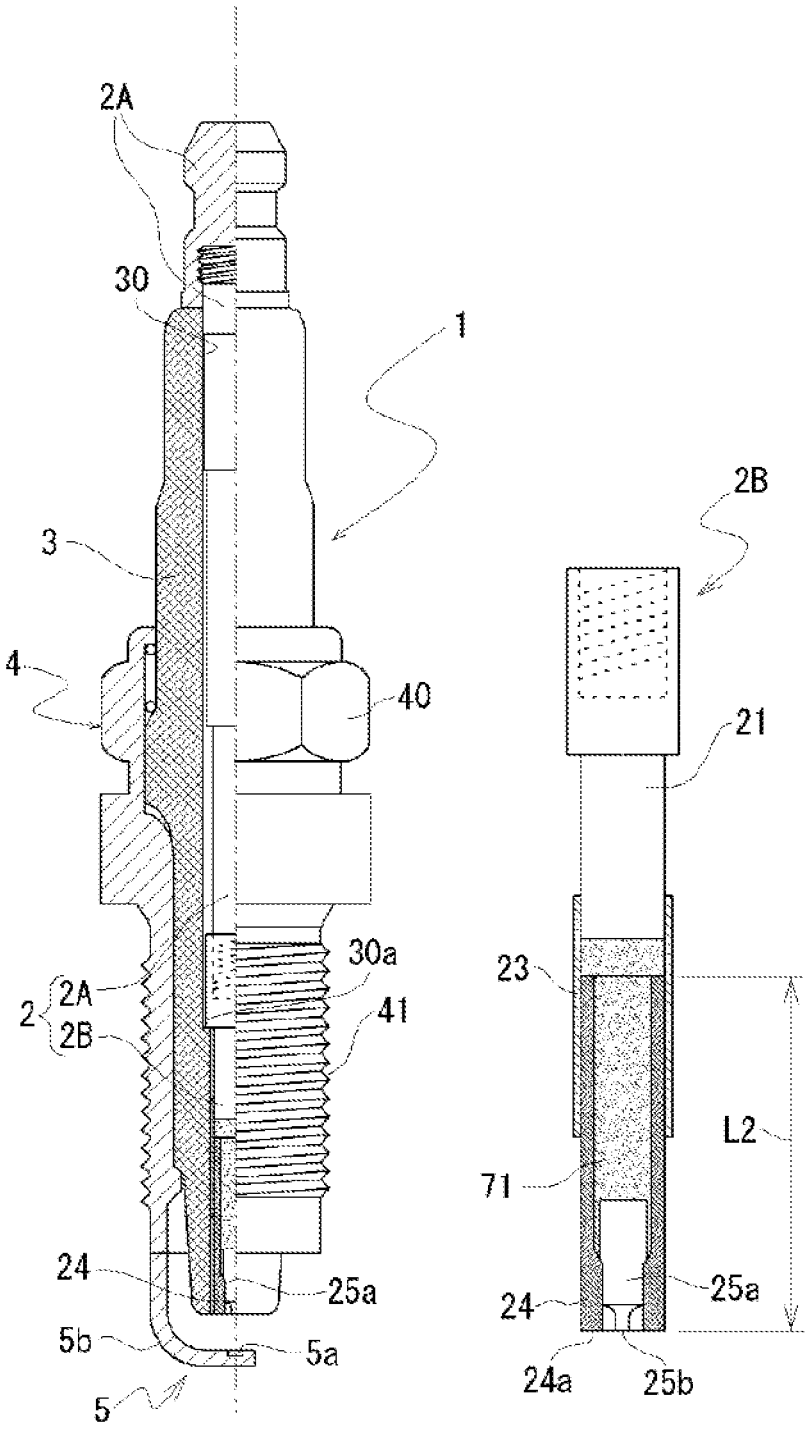
FIG. 3A is a partial cross sectional view of a spark plug according to a second embodiment of the present invention.
FIG. 3B is a partially enlarged cross sectional view of an electrode main body of the spark plug.

FIG. 3 shows the spark plug 1 according to the second embodiment. Similarly to the first embodiment, the spark plug 1 is provided with the central electrode 2 including the terminal fitting part 2A electrically supplied from outside and the electrode main body 2B electrically connected with the terminal fitting part 2A, the insulator 3 formed with an axial hole 30, which the electrode main body 2B of the central electrode 2 is fitted into, the main fitting 4 arranged in a manner so as to surround the insulator 3, the ground electrode 5 that extends from the tip end surface of the main fitting 4 and forms the discharge gap for the spark discharge with the electrode main body 2B of the central electrode 2. The terminal fitting part 2A of the central electrode 2 is electrically supplied with the pulse voltage for the spark discharge and the electromagnetic wave provided as energy to the spark discharge.

The electrode main body 2B is constituted of a connection conductor 21 electrically connected with the terminal fitting part 2A, a coupling conductive cylinder 23 coupled with the connection conductor 21 on a side opposite to the terminal fitting part 2A, a front dielectric cylinder 24 fitted into an inner diameter side of the coupling conductive cylinder 23, and an electrode tip part 25*a* inserted into the front dielectric cylinder 24. A tip end surface 25*b* of the electrode tip part 25*a* is located within the front dielectric cylinder 24 or approximately on the same plane as a ground-electrode-side end surface 24*a* of the front dielectric cylinder 24. The connection conductor 21 is electrically connected with the electrode tip part 25*a* via a resistor or a conductor.

Each conductive constituents of the central electrode 2 is not limited to particular material as long as it is made of metal. However, a low impedance metal may be employed such as silver, copper, gold, aluminum, tungsten, molybdenum, titanium, zirconium, niobium, tantalum, bismuth, lead, tin, an alloy essentially composed of these metals, a composite material of these metals, and/or a material coated with these metals. Especially, a material coated with titanium is preferably employed.

Hereinafter, a description will be given of configuration of the electrode main body 2B. As described above, the electrode main body 2B is constituted of the connection conductor 21, the coupling conductive cylinder 23, the front dielectric cylinder 24, and the electrode tip part 25*a*. The electrode tip part 25*a* is provided on an outer surface thereof with a ramp part having a small diameter on a front side of the central electrode 2, the front dielectric cylinder 24 is provided on a front inner surface thereof with a ramp part having a large diameter on a rear side of the central electrode 2, and the ramp part of the electrode tip part 25*a* is engaged with the ramp part of the front dielectric cylinder 24. Here, it is to be noted that the position of the ramp parts are determined so that the tip end surface 25*b* of the electrode tip part 25*a* locates within the front dielectric cylinder 24 or approximately on the same plane as the ground-electrode-side end surface 24*a* of the front dielectric cylinder 24. As a tip end part of the electrode tip part 25*a*, similarly to the first embodiment, a noble metal having a high melting point and oxidation resistance such as platinum alloy and iridium may be preferably employed. As the front dielectric cylinder 24, similarly to the first embodiment, a ceramic based on alumina ($Al_2O_3$) or the like having high insulation and resistance to heat and corrosion is preferably employed. The length L2 of the front dielectric cylinder 24 is preferably $\lambda/4$ or more in an axial direction, assuming that the wavelength of the supplied electromagnetic wave (microwave) is $\lambda$. A rear side outer peripheral surface of the front dielectric cylinder 24 is fitted into a through hole of the coupling conductive cylinder 23. In this state, a resistor composition powder 71 or a conductive mixed powder 70 is filled in the front dielectric cylinder 24 and the coupling conductive cylinder 23. Subsequently, the connection conductor 21 is fitted into the through hole of the coupling conductive cylinder 23. Finally, by heating at a temperature (900 to 1000 degrees Celsius) higher than the glass softening point, the connection conductor 21, the coupling conductive cylinder 23, the front dielectric cylinder 24, and the electrode tip part 25*a* are sealed and integrally formed. However, a method of the integral forming is not limited to this.

Although the connection conductor 21 and the electrode tip part 25*a* are electrically connected with each other by softening and sealing the resistor composition powder 71 or the conductive mixed powder 70, an axis-like conductor or a coiled spring may be employed to couple the connection conductor 21 and the electrode tip part 25*a*. In a case in which a resistor configured by softening and sealing the resistor composition powder 71 is employed to electrically connect the connection conductor 21 and the electrode tip part 25*a*, it is possible to effectively prevent the above described electric noise in the internal combustion engine for vehicle.

The connection conductor 21 is formed with a large diameter ramp part having a large diameter on a side opposite to the electrode tip part 25*a* for a purpose of engaging with a ramp part 30*a* formed on an inner surface of the insulator 3, which will be described later. The large diameter ramp part is formed at an end surface thereof with a connection unit to connect with the tip end of the terminal fitting part 2A. The connection unit may be a female threaded hole part to be threaded with a male thread formed on a front outer peripheral surface of the terminal fitting part 2A. Furthermore, the connection conductor 21 and the terminal fitting part 2A may be integrally formed.

Subsequently, the large diameter ramp part of the connection conductor 21 is engaged with the ramp part 30*a* of the axial hole 30 so that the ground-electrode-side end surface 24*a* of the front dielectric cylinder 24 of the integrally formed electrode main body 2B should locate on the same plane as a tip end of the insulator 3. Finally, a predetermined amount of the conductive mixed powder 70 is filled in a gap on a side of the electrode tip part 25*a* lower than the large diameter ramp part and heated at a temperature higher than the glass softening point, thereby sealing and fixing the electrode main body 2B to the insulator 3. In the present embodiment, the conductive mixed powder 70 is employed to join the electrode main body 2B to the insulator 3, and therefore may be configured by a glass powder alone without including a conductive powder. A method of fixing the electrode main body 2B is not limited to this.

According to the above described configuration, in the spark plug 1 according to the second embodiment, the discharge current for the spark discharge that has electrically supplied from the terminal fitting part 2A flows through a center of the electrode main body 2B and causes the spark discharge at a gap part between the electrode tip part 25*a* and the ground electrode tip part 5*a*. While, on the other hand, the electromagnetic wave (microwave) provided as energy to the spark discharge is emitted in a ring shape so as to surround the axial center of the central electrode 2 from the ground-electrode-side end surface 24*a* of the front dielectric cylinder 24 via the coupling conductive cylinder 23 and the front dielectric cylinder 24, thereby preventing temperature rise at the axial center part of the central electrode 2.

Effect of Second Embodiment

In the spark plug 1 according to the second embodiment, similarly to the first embodiment, whereas the electric field caused by the discharge current becomes maximum in intensity at the axial center of the central electrode 2, the electric field caused by the electromagnetic wave becomes maximum in intensity on more outer side than the axial center of the central electrode 2 (in a ring shape centering on the axial center), and a high temperature part does not concentrate on the axial center part of the central electrode 2. Thus, it becomes possible to effectively prevent erosion of the tip end of the electrode tip part 25*a*, which is the tip end part of the central electrode 2. Furthermore, it becomes possible to provide a spark plug having low power loss of the supplied electromagnetic wave. Furthermore, since the electrode main body 2B is modularized, it becomes possible to shorten a manufacturing process of the spark plug 1.

<Third Embodiment>

Spark Plug

The third embodiment is directed to the spark plug according to the present invention. The third embodiment is different from the spark plug of the first embodiment in structure of the electrode main body 2B of the spark plug. Descriptions are omitted of constituents similar to the first embodiment such as the insulator 3, the main fitting 4, the ground electrode 5, and the like.

Figure 6:
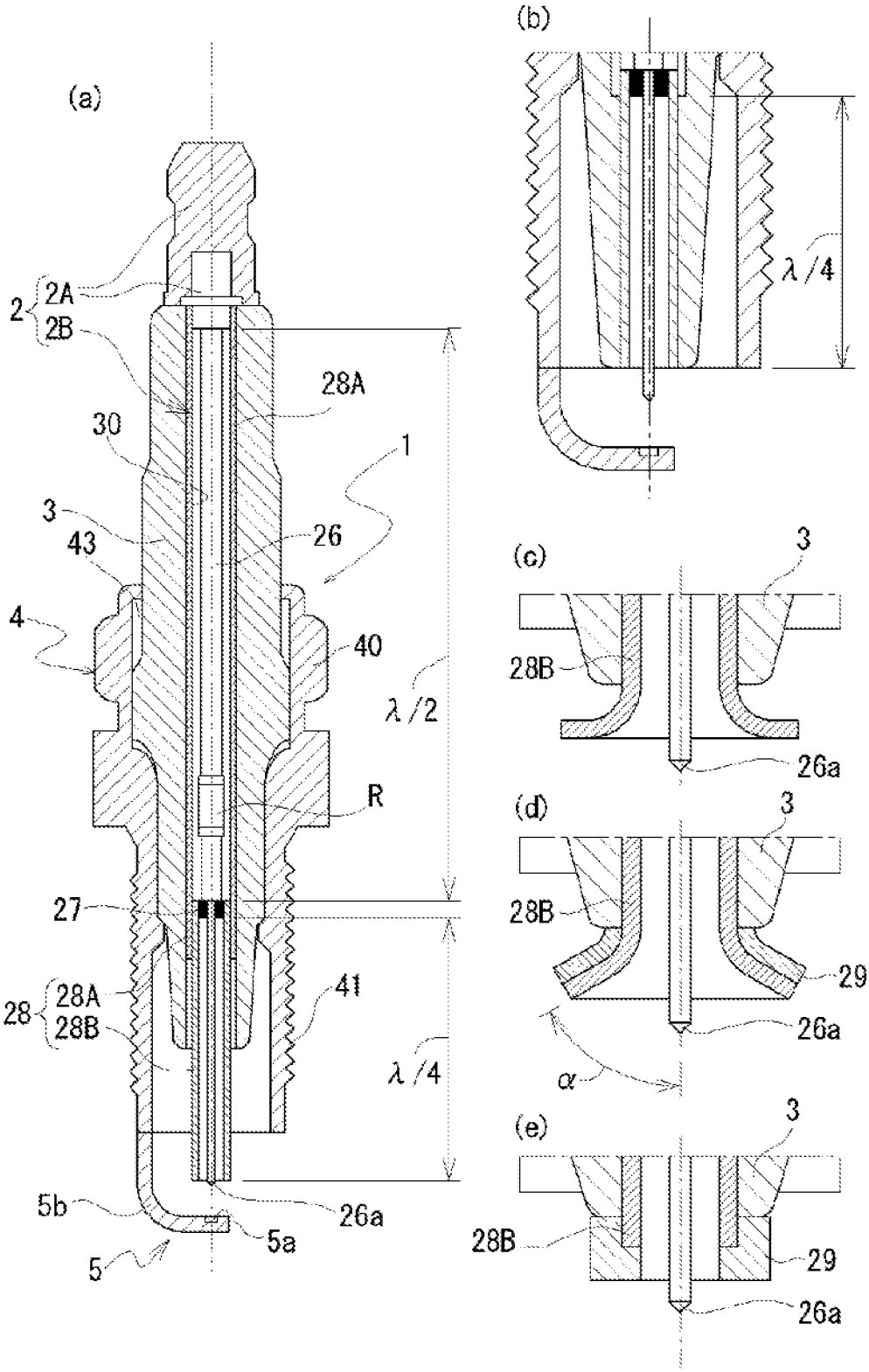
FIG. 6A is a partial cross sectional view of a spark plug according to a third embodiment of the present invention.
FIG. 6B is a partially enlarged cross sectional view showing a modified example of a front conductive cylinder and an insulator of the spark plug.
FIGS. 6C to 6E are partially enlarged cross sectional views showing other modified examples of an opening end of the front conductive cylinder of the spark plug.

FIG. 6 shows the spark plug 1 according to the third embodiment. The spark plug 1 is provided with a central electrode 2 including the terminal fitting part 2A electrically supplied from outside and the electrode main body 2B electrically connected with the terminal fitting part 2A, the insulator 3 formed with an axial hole 30, which the electrode main body 2B of the central electrode 2 is fitted into, the main fitting 4 arranged in a manner so as to surround the insulator 3, the ground electrode 5 that extends from an end surface of the main fitting 4 and forms a discharge gap for a spark discharge with the electrode main body 2B of the central electrode 2. The terminal fitting part 2A of the central electrode 2 is electrically supplied with a pulse voltage for the spark discharge and an electromagnetic wave provided as energy to the spark discharge.

The electrode main body 2B of the central electrode 2 is constituted of a main central electrode 26 that extends from a center part of an end surface of the terminal fitting part 2A and has a diameter smaller than an outer diameter of the terminal fitting part 2A and a tube-like shaped conductive cylinder 28 that covers the main central electrode 26 and has a diameter approximately equal to the outer diameter of the terminal fitting part 2A. The conductive cylinder 28 is constituted of a rear conductive cylinder 28A electrically connected with the terminal fitting part 2A and a front conductive cylinder 28B, one end of which is electrically connected with the rear conductive cylinder 28A, and the other end of which is located in the vicinity of the ground electrode 5.

The method of joining the insulator 3 and the central electrode 2 is not particularly limited. However, an adhesive member such as a ceramic adhesive may be filled between an outer peripheral surface of the rear conductive cylinder 28A and an inner peripheral surface of the axial hole 30, thereby joining the insulator 3 and the central electrode 2. Also, the method of joining the main fitting 4 and the insulator 3 joined to the central electrode 2 is not particularly limited. However, the main fitting 4 and the insulator 3 joined to the central electrode 2 may be joined by means of an adhesive member such as a ceramic adhesive. Furthermore, to prevent a gas leakage from a combustion chamber to outside, it is preferable to employ a sealing structure such that a talc is filled in a gap 43 between the insulator 3 and an upper end side (a side opposite to the ground electrode 5) of the main fitting 4, and the upper end side is bent inward (caulked).

The main central electrode 26 is supported at a connection part of the rear conductive cylinder 28A and the front conductive cylinder 28B via an insulating material 27 in a tube-like shape. A part of the main central electrode 26 is provided with an intervening resistor R at an appropriate position covered by the rear conductive cylinder 28A. As a result of this, it is possible to effectively perform the above described electric noise prevention in the internal combustion engine for vehicle.

Assuming that the wavelength of the supplied electromagnetic wave is λ, a length of a ring-like shaped gap between the front conductive cylinder 28B and the main central electrode 26 is configured to be λ/4 in an axial direction, and a length of a ring-like shaped gap between the rear conductive cylinder 28A and the main central electrode 26 is configured to be λ/2 in the axial direction. By configuring the ring-like shaped gap between the rear conductive cylinder 28A and the main central electrode 26 to form a resonating structure serving as an imaginary ground, the ring-like shaped gap between the front conductive cylinder 28B and the main central electrode 26 is configured to form the front resonating structure having the length of λ/4. It would be possible for a part of the electromagnetic wave flowing on the surfaces of the rear conductive cylinder 28A and the front conductive cylinder 28B to flow in the ring-like shaped gap between the front conductive cylinder 28B and the main central electrode 26 without being emitted from the opening end surface of the front conductive cylinder 28B into a combustion chamber. However, by thus configuring, it is possible to forcibly emit the aforementioned part of the electromagnetic wave into the combustion chamber, thereby increasing the electric field intensity.

Between parts of the main central electrode 26 respectively covered by the rear conductive cylinder 28A and the front conductive cylinder 28B, the part covered by the front conductive cylinder 28B is preferably smaller in outer diameter than the part covered by the rear conductive cylinder 28A. Accordingly, it is possible to ensure a volume of the front resonating structure and to configure the front resonating structure higher in impedance than the resonating structure of the imaginary ground formed by the ring-like shaped gap between the rear conductive cylinder 28A and the main central electrode 26.

An electrode tip part 26*a* at a tip end of the main central electrode 26 protrudes from an opening end surface of the front conductive cylinder 28B and is preferably in a nib-like shape so as to easily discharge. By thus configuring, the front conductive cylinder 28B is more distant from the ground electrode 5 than the electrode tip part 26*a*. Consequently, an applied high voltage does not cause a spark discharge between the tip end part of the front conductive cylinder 28B and the ground electrode 5.

As shown in FIG. 6B, an end part on a ground electrode side of the front conductive cylinder 28B is aligned with an end part on the ground electrode side of the main fitting 4, and a space between an outer peripheral surface of the front conductive cylinder 28B and an inner peripheral surface of the main fitting 4 is configured to be λ/4 in length in an axial direction, thereby causing the space between the outer peripheral surface of the front conductive cylinder 28B and the inner peripheral surface of the main fitting 4 to form the resonating structure at a length of λ/4. As a result of this, it is possible to increase the electric field intensity of the electromagnetic wave emitted from the opening end (the end part on the ground electrode side) of the front conductive cylinder 28B.

Effect of Third Embodiment

According to the spark plug 1 of the present embodiment, by forming the front resonating structure, it is possible to forcibly emit to a combustion chamber a part of the electromagnetic wave flowing on the surfaces of the rear conductive cylinder 28A and the front conductive cylinder 28B, which would not have emitted from the opening end surface of the front conductive cylinder 28B into the combustion chamber and have flowed in the ring-like shaped gap between the front conductive cylinder 28B and the main central electrode 26 if it were not for the front resonating structure, thereby increasing the electric field intensity. Furthermore, similarly to the first and second embodiments, whereas the electric field caused by the discharge current becomes maximum in intensity at the axial center of the main central electrode 26, the electric field caused by the electromagnetic wave becomes maximum in intensity on more outer side than the axial center of the main central electrode 26 (in the ring-shape centering on the axial center). Accordingly, since the high temperature part does not concentrate on the axial center part of the main central electrode 26, it is possible to effectively prevent erosion of the tip end of the electrode tip part 26*a*, which is the tip end part of the main central electrode 26.

<First Modified Example of Third Embodiment>

According to the first modified example of the third embodiment, as shown in FIG. 6C, the opening end (on the ground electrode 5 side) of the front conductive cylinder 28B is spread open so as to form a spread part. Although the spread part is not particularly limited, the spread part may be spread perpendicular to the axial center of the central electrode 2, as shown in FIG. 6C, or may form a predetermined angle α in relation to the axial center of the central electrode 2, as shown in FIG. 6D. Although the angle α is not limited to a particular value, a may be between 10 to 80 degrees, or preferably between 30 to 60 degrees. As a result of this, the electric field caused by the electromagnetic wave becomes maximum in intensity at a ring-shaped location further distant from the axial center of the central electrode 2 (the main central electrode 26), and it is possible to effectively prevent erosion of the tip end part (the electrode tip part 26*a*) of the central electrode 2. Furthermore, it is possible to easily enlarge generated plasma from the axial center part of the spark plug 1 toward a wall surface of an engine cylinder.

A high melting point metal 29 may be provided at the opening end of the front conductive cylinder 28B. More particularly, as shown in FIG. 6D, the high melting point metal 29 is joined (for example, welded, brazed, or the like) to an outer surface of the spread opening end of the front conductive cylinder 28B so as to abut on an end surface of the insulator 3. Also, as shown in FIG. 6E, without spreading the opening end of the front conductive cylinder 28B, the high melting point metal 29 may be employed to constitute the spread part. By providing the front conductive cylinder 28B at the opening end thereof with the high melting point metal 29, it is possible to dissipate toward a side of the insulator 3 heat produced from the front conductive cylinder 28B (heat produced by plasma generation), and effectively prevent erosion of the opening end of the front conductive cylinder 28B.

Fourth Embodiment

Plasma Generation Device

Figure 4:
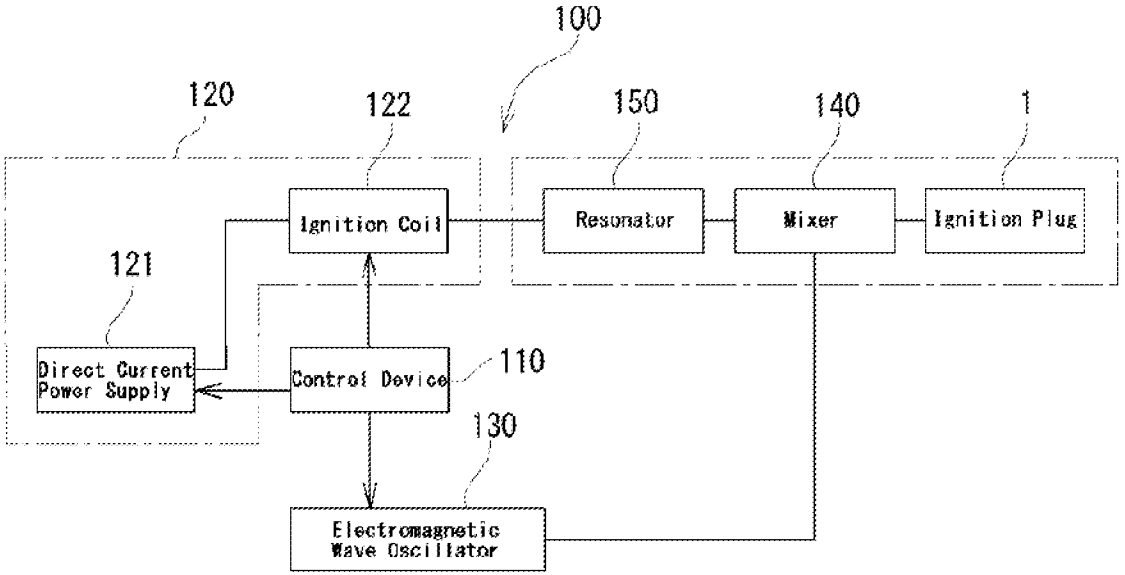
FIG. 4 is a schematic diagram of a plasma generation device according to a fourth embodiment of the present invention.
Figure 5:
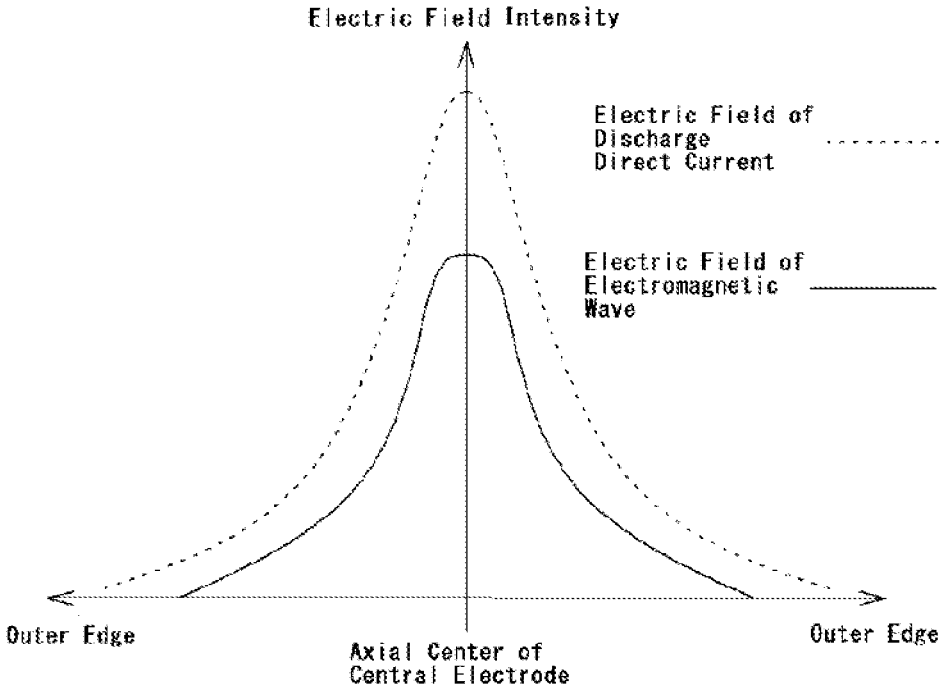
FIG. 5 is a graph showing electric field intensity distributions of a conventional spark plug respectively caused by a discharge current and an electromagnetic wave.

As shown in FIG. 4, a plasma generation device 100 according to the present embodiment is provided with a control device 110, a high voltage pulse generation device 120, an electromagnetic wave oscillator 130, a mixer 140, and the spark plug 1. The high voltage pulse generation device 120 is constituted of a direct current power supply 121 and an ignition coil 122. Energies respectively generated by the high voltage pulse generation device 120 and the electromagnetic wave oscillator 130 are transmitted to the spark plug 1 via the mixer 140. The mixer 140 mixes the energies supplied from the high voltage pulse generation device 120 and the electromagnetic wave oscillator 130 respectively at different times.

The energies mixed in the mixer 140 are supplied to the spark plug 1. The high voltage pulse energy supplied to the spark plug 1 causes a spark discharge at a gap part between the ground electrode tip part 5*a* and the electrode tip part 25*a* of the central electrode 2 of the spark plug 1. Meanwhile, the electromagnetic wave (microwave) energy generated from the electromagnetic wave oscillator 130 enlarges and maintains the discharge plasma generated by the spark discharge. The control device 110 controls the direct current power supply 121, the ignition coil 122, and the electromagnetic wave oscillator 130 to adjust respective timings, intensity, or the like of discharging from the spark plug 1 and feeding the microwave energy, thereby realizing a desired combustion state.

High Voltage Pulse Generation Device

The high voltage pulse generation device 120 includes the direct current power supply 121 and the ignition coil 122. The ignition coil 122 is electrically connected with the direct current power supply 121. The ignition coil 122, upon receiving an ignition signal from the control device 110, boosts a voltage applied from the direct current power supply 121. The boosted pulse voltage (high voltage pulse) is outputted to the spark plug 1 via a resonator 150 and the mixer 140.

The control device 110 controls so that the microwave is generated at a timing delayed by a predetermined time from a turn-off timing of the signal to the ignition coil 122. As a result of this, the microwave energy is effectively supplied to ionized gasses generated by the discharge, i.e. plasma, and the plasma enlarges and expands.

Electromagnetic Wave Oscillator

Upon receiving an electromagnetic drive signal from the control device 110, the electromagnetic wave oscillator 130 repeatedly outputs a microwave pulse during a period of time of a pulse width of the electromagnetic wave drive signal with a predetermined oscillation pattern. In the electromagnetic wave oscillator 130, a semiconductor oscillator generates the microwave pulse. In place of the semiconductor oscillator, another kind of oscillator such as magnetron may be employed. As a result of this, the microwave pulse is outputted to the mixer 140.

In the above, it has been described that one electromagnetic wave oscillator 130 is provided to one spark plug 1 (one cylinder). In a case of a plurality of cylinders such as four cylinder internal combustion engine, it is preferably configured such that the microwave pulse from the electromagnetic wave oscillator 130 is branched and outputted to each plasma generation device 100 by means of a branching unit (not shown). In this case, the microwave attenuates while passing through the branching unit such as a switch. Consequently, it is preferably configured such that the electromagnetic wave oscillator 130 has low output such as 1 W, and before inputting to the mixer 140 of each plasma generation device 100, the microwave passes through an amplifier (not shown). This means that it is preferably configured such that an amplifier such as a power amplifier is provided in place of the electromagnetic wave oscillator 130 in FIG. 4.

The resonator 150 is a unit such as a cavity resonator adapted to resonate with the microwave leaking toward a side of the ignition coil 122 from the mixer 140. It is possible to suppress a leakage of the microwave toward the side of the ignition coil 122 by causing the microwave to resonate in the resonator 150.

The plasma generation device 100 according to the above described configuration employs the spark plug 1 according to the first embodiment or the second embodiment for sparking the discharge and emitting the electromagnetic wave (microwave) into a combustion chamber of the internal combustion engine. Accordingly, it is possible to greatly reduce the erosion of the electrode tip part 25*a*, to use the spark plug 1 for a long time period, and to greatly reduce the power loss. As a result of this, the frequency of replacement of the spark plug 1 is reduced, and it is possible to downsize the electromagnetic wave oscillator 130, and to reduce the size and cost of the overall device.

INDUSTRIAL APPLICABILITY

As described above, according to the present invention, whereas the discharge current for the spark discharge flows through the center of the central electrode 2, the electromagnetic wave (microwave) provided as energy to the spark discharge is emitted in a ring-like shape so as to surround the axial center of the central electrode 2. Accordingly, since it is possible to prevent temperature rise at the axial center of the central electrode 2, the spark plug 1 is suitably applied to the plasma generation device 100 supplied with a discharge voltage for the spark discharge and the microwave provided as energy to the spark discharge. Consequently, in an internal combustion engine such as a vehicle engine employing the plasma generation device 100 according to the present invention, it becomes possible to use each spark plug for a long period of time. As a result of this, the internal combustion engine employing the plasma generation device 100 according to the present invention is widely applicable to a vehicle, an airplane, a ship, and the like.

EXPLANATION OF REFERENCE NUMERALS

1 Spark Plug
2 Central Electrode
2A Terminal Fitting Part
2B Electrode Main Body
3 Insulator
30 Axial Hole
4 Main Fitting
5 Ground Electrode
5*a* Ground Electrode Tip Part
5*b* Ground Electrode Main Body
21 Connection Conductor
23 Coupling Conductive Cylinder
24 Front Dielectric Cylinder
24*a* Ground-Electrode-Side End Surface

25 Front Electrode
25*a* Electrode Tip Part
25A Electrode Tip Part Main Body
25*b* Tip End Surface
25B Coupling Body
26 Main Central Electrode
27 Insulating Material
28 Conductive Cylinder
28A Rear Conductive Cylinder
28B Front Conductive Cylinder
100 Plasma Generation Device
110 Control Device
120 High Voltage Pulse Generation Device
121 Direct Current Power Supply
122 Ignition Coil
130 Electromagnetic Wave Oscillator
140 Mixer
150 Resonator

What is claimed is:

1. A spark plug, comprising:

a central electrode including a terminal fitting part electrically supplied from outside and an electrode main body electrically connected with the terminal fitting part;

an insulator formed with an axial hole, which the central electrode is fitted into;

a main fitting arranged in a manner so as to surround the insulator; and a ground electrode, which extends from an end surface of the main fitting and is adapted to form a discharge gap for a spark discharge with the electrode main body, wherein the terminal fitting part is electrically supplied with a pulse voltage for the spark discharge and an electromagnetic wave provided as energy to the spark discharge, and the electrode main body is constituted of a front electrode including an electrode tip part for causing the spark discharge with the ground electrode, a front dielectric cylinder in a tithe-like shape covering the electrode tip part, and a coupling conductive cylinder in the tube-like shape joining the front dielectric cylinder and the terminal fitting part.

2. A spark plug, comprising:

a central electrode including a terminal fitting part electrically supplied from outside and an electrode main body electrically connected with the terminal fitting part;

an insulator formed with an axial hole, which the central electrode is fitted into;

a main fitting arranged in a manner so as to surround the insulator; and a ground electrode which extends from an end surface of the main fitting and is adapted to form a discharge gap for a spark discharge with the electrode main body, wherein the terminal fitting part is electrically supplied with a pulse voltage for the spark discharge and an electromagnetic wave provided as energy to the spark discharge, and the electrode main body is constituted of a connection conductor electrically connected with the terminal fitting part, a coupling conductive cylinder coupled with the connection conductor on a side opposite to the terminal fitting part, a front dielectric cylinder fitted into an inner diameter side of the coupling conductive cylinder, and an electrode tip part inserted into the front dielectric cylinder, and the connection conductor and the front electrode are electrically connected with each other via a resistor or a conductor.

3. The spark plug according to claim 2, wherein the resistor is made of a resistor composition powder filled in the front dielectric cylinder.

4. A spark plug, comprising:

a central electrode including a terminal fitting part electrically supplied from outside and an electrode main body electrically connected with the terminal fitting part;

an insulator formed with an axial hole, which the central electrode is fitted into;

a main fitting arranged in a manner so as to surround the insulator; and a ground electrode that extends from an end surface of the main fitting and is adapted to form a discharge gap for a spark discharge with the electrode main body, wherein the terminal fitting part is electrically supplied with a pulse voltage for the spark discharge and an electromagnetic wave provided as energy to the spark discharge, the electrode main body is constituted of a main central electrode that extends from a central part of an end surface of the terminal fitting part, a rear conductive cylinder that covers the main central electrode and is electrically connected with the terminal fitting part, and a front conductive cylinder, one end of which is electrically connected with the rear conductive cylinder and the other end of which locates in the vicinity of the ground electrode, the main central electrode is supported at the connection part of the rear conductive cylinder and the front conductive cylinder via a tube-like shaped insulating material, a length of a ring-like shaped gap between the front conductive cylinder and the main central electrode is configured to be $\lambda/4$ in an axial direction, and a length of a ring-like shaped gap between the rear conductive cylinder and the main central electrode is configured to be $\lambda/2$ in the axial direction, assuming that the wavelength of the supplied electromagnetic wave is $\lambda$.

5. The spark plug according to claim 4, wherein an opening end of the front conductive cylinder is spread open.

6. The spark plug according to claim 4, wherein a high melting point metal is provided at the opening end of the front conductive cylinder.

7. A plasma generation device, comprising:

an ignition coil for supplying a discharge voltage;

an electromagnetic wave oscillator that oscillates an electromagnetic wave;

a mixer that mixes energy for a discharge and energy of the electromagnetic wave; and the spark plug according to claim 1 that sparks a discharge and introduces the energy of the electromagnetic wave into a reaction region in which a combustion reaction or a plasma reaction is performed.

* * * * *